US007225884B2

(12) United States Patent
Aeberhard

(10) Patent No.: US 7,225,884 B2
(45) Date of Patent: Jun. 5, 2007

(54) HAND POWER TOOL, IN PARTICULAR DRILLING SCREWDRIVER

(75) Inventor: Bruno Aeberhard, Studen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/256,741

(22) Filed: Oct. 24, 2005

(65) Prior Publication Data

US 2006/0086514 A1 Apr. 27, 2006

(30) Foreign Application Priority Data

Oct. 26, 2004 (DE) ..... 10 2004 051 911

(51) Int. Cl.
*B25B 23/159* (2006.01)

(52) U.S. Cl. ..... 173/93.5; 173/48; 173/93; 173/205; 173/216

(58) Field of Classification Search ..... 173/48, 173/104, 93, 93.5, 216, 205, 109, 112, 178, 173/91

See application file for complete search history.

(56) References Cited

U.S. PATENT DOCUMENTS 5,458,206 A * 10/1995 Bourner et al. ..... 173/178
5,531,278 A * 7/1996 Lin ..... 173/176
5,842,527 A * 12/1998 Arakawa et al. ..... 173/48
6,142,242 A * 11/2000 Okumura et al. ..... 173/48
6,192,996 B1 * 2/2001 Sakaguchi et al. ..... 173/48
6,688,406 B1 * 2/2004 Wu et al. ..... 173/48
6,691,796 B1 * 2/2004 Wu ..... 173/48
6,892,827 B2 * 5/2005 Toyama et al. ..... 173/48
6,976,545 B2 * 12/2005 Greitmann ..... 173/104

FOREIGN PATENT DOCUMENTS

DE 100 06 641 A1 9/2000

* cited by examiner

*Primary Examiner*—Brian Nash
(74) *Attorney, Agent, or Firm*—Michael J. Striker

(57) ABSTRACT

A hand power tool has a tool spindle rotatable by a drive train, a cam device located in the drive train and having two cam discs in engagement with one another for transmitting axial percussion motions to the tool spindle, an overloading coupling located in the drive train and having two coupling parts which are in engagement with one another and are overloadable counter to an axially exerted force, a blocking device which upon its activation blocks a relative rotation of the coupling parts of the overloading coupling to one another, and an operating mode setting device for setting "percussion drilling", "drilling" and "screw driving" operating modes, and also a magnitude of an overlocking moment upon screwdriving and having one torque adjusting ring for setting the "drilling" operating mode and the "screwdriving" operating mode, with preselection of the magnitude of the overlocking moment, and another adjusting the "percussion drilling" operating mode on and off, and in "on" position overrides any operating mode set by the torque adjusting ring.

14 Claims, 6 Drawing Sheets

HAND POWER TOOL, IN PARTICULAR DRILLING SCREWDRIVER

BACKGROUND OF THE INVENTION

The present invention relates to a hand power tool, in particular a drilling screwdriver.

In a known power percussion drill with a device for changing operating modes (German Patent Disclosure DE 100 06 641 A1), the adjusting or changing device has two adjusting rings or changing rings, which are located side by side on the power tool housing and are embodied such that one changing ring, in three successive setting positions, calls up the "percussion drilling" operating mode, the "drilling" operating mode, and the "screwdriving" operating mode, and the other changing ring, in the "percussion drilling" operating mode, over a plurality of setting positions predetermines the overlocking or overloading moment or torque of the overlocking or overloading coupling.

The changing device furthermore has a blocking device or disengagement device, which in the "percussion drilling" and "drilling" operating modes blocks the overlocking or overloading capability of the overlocking coupling. In the third setting position of the first changing ring, for calling up the "percussion drilling" operating mode, the disengagement device is deactivated, and the overlocking moment or torque of the overlocking coupling is determined by a coupling spring, whose spring prestressing is adjustable by means of the second changing ring.

SUMMARY OF THE INVENTION

In keeping with these objects and with others which will become apparent hereinafter, one feature of the present invention resides, briefly stated, in a hand power tool, in particular a drilling screwdriver, which is a further improvement of the existing hand power tools.

In keeping with these objects and with others which will become apparent hereinafter, one feature of the present invention resides, briefly stated, in a hand power tool, comprising a power tool housing; a tool spindle supported rotatably in said housing; a drive train via which said tool spindle is drivable to rotate; a cam device located in said drive train and having two cam discs in engagement with one another for transmitting axial percussion motions to said tool spindle; an overlocking or overloading coupling located in said drive train and having two coupling parts which are in engagement with one another and are overlockable or overloadable counter to an axially exerted force; a coupling spring exerting said axial force; a blocking device which upon its activation blocks a relative rotation of said coupling parts of said overlocking coupling to one another; and an operating mode setting device for setting "percussion drilling", "drilling" and "screw driving" operating modes, and also a magnitude of an overlocking or overloading moment upon screwdriving, said operating mode setting device having two adjusting rings located on said power tool housing and rotatable manually to define setting positions and acting on said cam device, said overlocking coupling and said blocking device, wherein one of said adjusting rings is a torque adjusting ring and sets the "drilling" operating mode and the "screwdriving" operating mode, with preselection of the magnitude of the overlocking moment, while the other of said adjusting rings is embodied as a function adjusting ring and switches the "percussion drilling" operating mode on and off, and in its position that switches the "percussion drilling" operating mode on, it overrides any operating mode set by said torque adjusting ring.

When the hand power tool is designed in accordance with the present invention it has the advantage that the operating modes of "percussion drilling", "drilling" and "screwdriving" with preselection of the overlocking moment or torque are divided up more logically between the adjusting rings and can be called up by means of shorter rotation paths of the adjusting rings. Hence regardless of the instantaneous setting of the torque adjusting ring, the percussion drilling function can be engaged by transferring the function adjusting ring to its one setting position. If the percussion drilling function is disengaged again by rotating the function adjusting ring in reverse, then the hand power tool resumes the operating mode specified at that instant by the torque adjusting ring. For setting the "percussion drilling" operating mode from the "drilling" or the "screwdriving" operating mode, thus the function adjusting ring merely needs to be rotated by a small rotary angle and does not—as in the known hand power tool—have to travel through the wide torque adjusting range of the "screwdriving" operating mode. The operating mode setting device is distinguished by good ergonomics and ease of use and has an attractive appearance.

In an advantageous embodiment of the invention, the torque adjusting ring, which has a plurality of setting positions, accesses the overlocking coupling and the blocking device in such a way that in the setting position of the torque adjusting ring that trips the drilling function, the blocking device is activated, while in the other setting positions of the torque adjusting ring it is deactivated, and the coupling spring of the overlocking coupling is prestressed variously strongly. The setting positions of the torque adjusting ring are preferably located such that with an increasingly long rotary path of the torque adjusting ring, the overlocking moment increases from one setting position to the next, and the setting position for calling up the drilling function adjoins the last one of these further setting positions. The function adjusting ring, which has only two setting positions, accesses the cam device and the blocking device, in such a way that in one setting position, the percussion drilling function is engaged and the blocking device is activated, and in the other setting position, the percussion drilling function is disengaged and the blocking device is deactivated.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
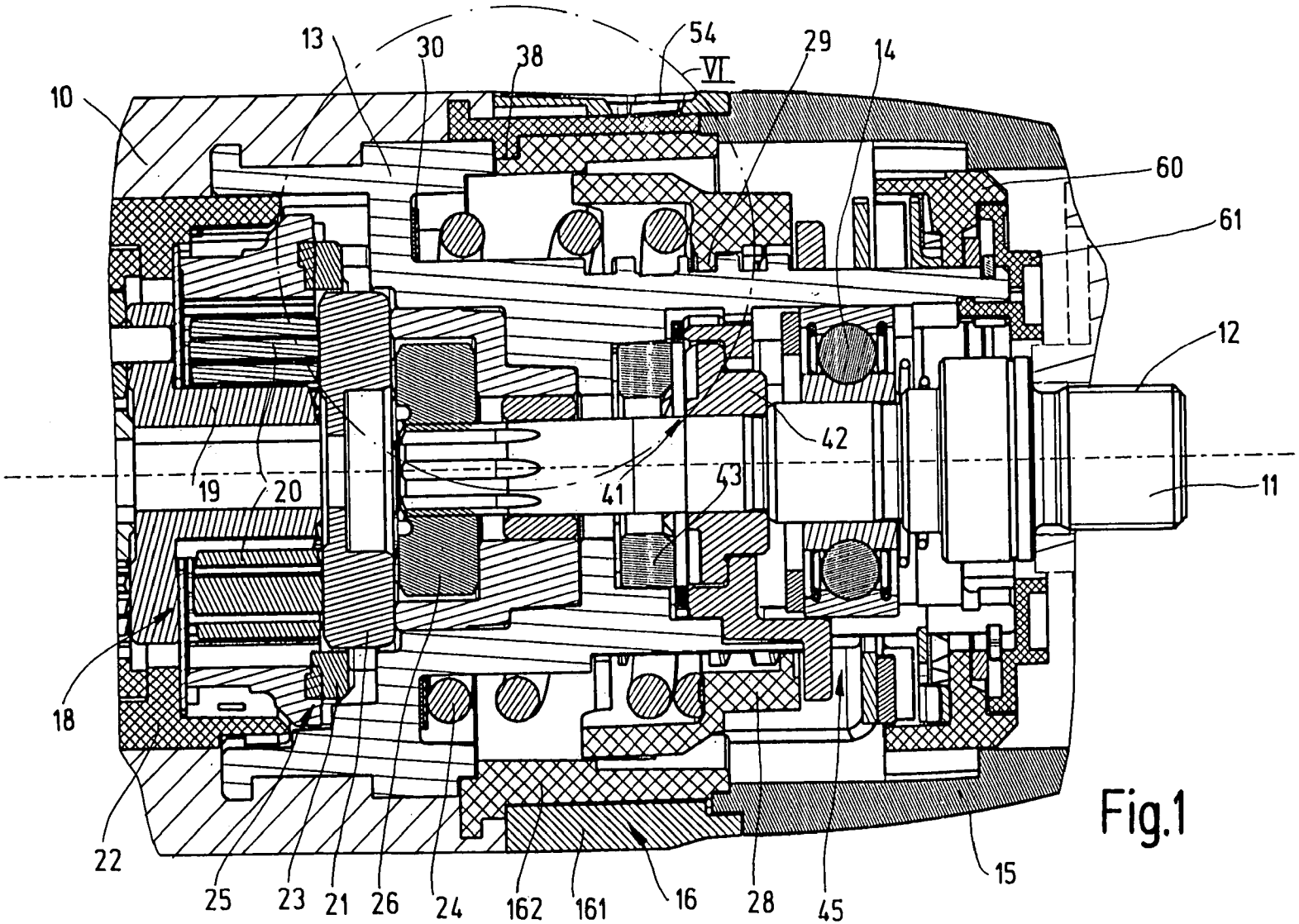
FIG. 1 is a fragmentary longitudinal section through a hand power tool.
Figure 3:
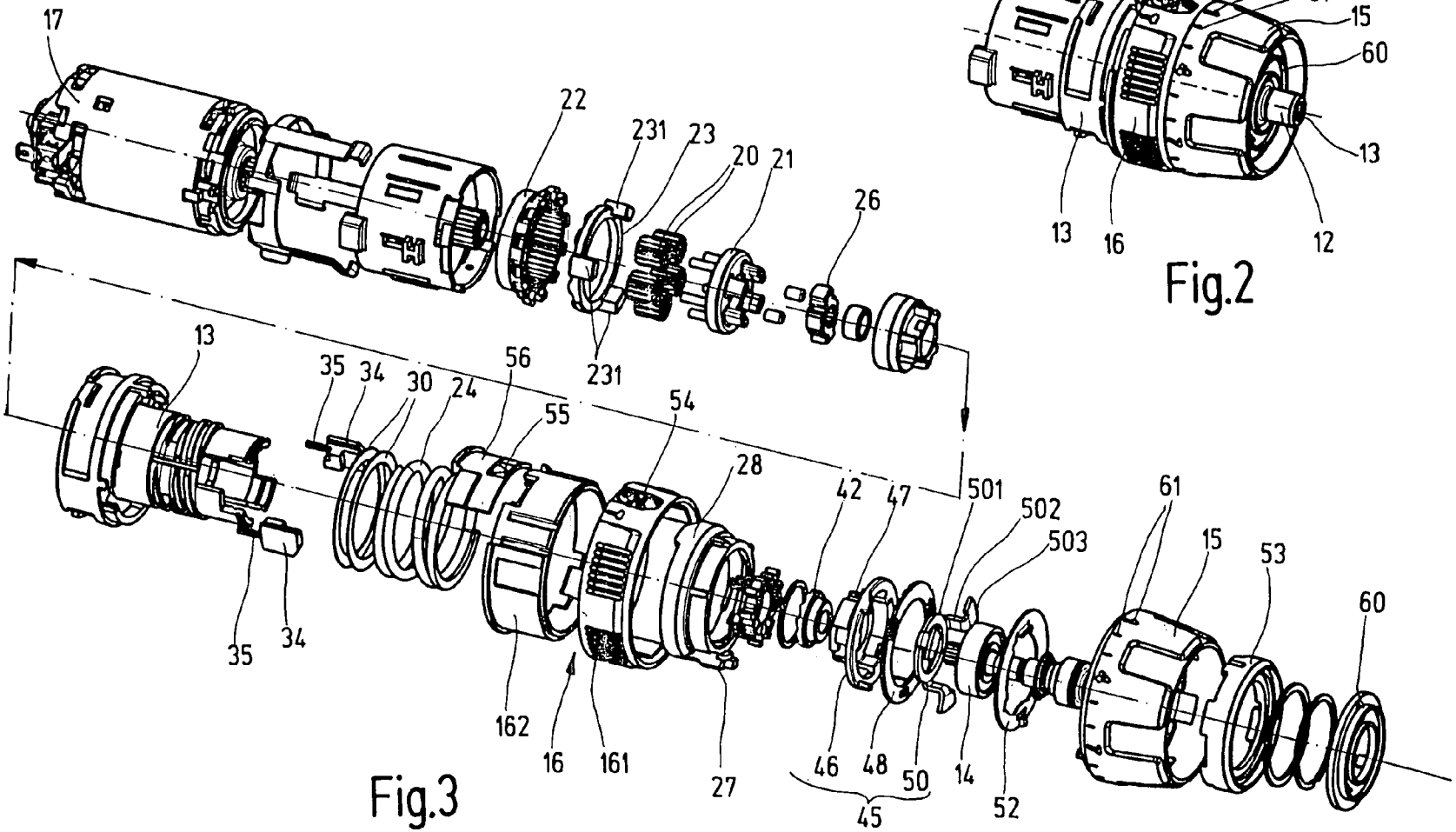
FIG. 3 is an exploded view of the hand power tool, without its power tool housing.

With the hand power tool shown in fragmentary form in longitudinal section in FIG. 1 and without its housing in an exploded view in FIG. 3, also known as a drilling screwdriver, work can be done in three different types or modes of operation, namely in the "percussion drilling" operating mode, the "drilling" operating mode, and the "screwdriving" operating mode; in the "screwdriving" operating mode, a tightening torque in various magnitudes, specifically in fifteen different magnitudes in this exemplary embodiment, can be preselected. If this torque is exceeded, then an overlocking coupling becomes operative, and the screwdriver is not driven further.

The hand power tool has a power tool housing 10, in which a rotationally drivable tool spindle 11 is rotatably supported. The tool spindle 11 protrudes from the face end of the power tool housing 10 and on its protruding end has a thread 12 onto which a tool holder, not shown here, can be screwed, in which holder a drill, screwdriver or percussion drill can be fastened. In the front region, a guide sleeve 13 is fixedly joined to the power tool housing 10. The end of the guide sleeve 13 on the power takeoff side of the spindle is dynamically closed off from the rotating tool holder, for the sake of preventing the entry of dust, by means of a cap 60 with an integrated dust labyrinth 61 (FIG. 1).

The tool spindle 11 is rotatably held in the guide sleeve 13 via a ball bearing 14, on the one hand, and on the other, two rotatable adjusting rings of an operating mode setting device are located axially side by side on the guide sleeve 13, for calling up the operating modes of the hand power tool. With the torque adjusting ring 15, the "drilling" operating mode and the "screwdriving" operating mode are called up, and simultaneously in the "screwdriving" operating mode, the desired tightening torque for a screwdriver is preselected. With the function adjusting ring 16, the "percussion drilling" operating mode is engaged and disengaged again.

The rotational drive of the tool spindle 11 is effected by an electric motor 17 (FIG. 3) via a planetary gear 18, which has a sun wheel 19, seated on the tool spindle 11 in a manner fixed against relative rotation; planet wheels 20, which mesh with the sun wheel 19 and are supported on a planet wheel carrier 21; and a ring gear 22, whose internal toothing meshes with the planet wheels 20. The ring gear 22, together with a transmission ring 23 that is axially displaceably retained on the guide sleeve 13 and with a coupling spring 24, embodied as a helical compression spring, that is slipped onto the guide sleeve 13, forms an overlocking or overloading coupling 25, in which transmission means, located on the face end of the ring gear 22 and the transmission ring 23, are kept in engagement with one another by their pressure force of the coupling spring 24.

As long as the torque or overlocking or overloading moment predetermined by the prestressing force of the coupling spring 24 is not attained, the ring gear 22 is held nonrotatably on the guide sleeve 13, and the tool spindle 11 is driven via the planet wheel carrier 21, which is braced on the tool spindle 11 and coupled to it in a manner fixed against relative rotation via a slaving means 26 (FIGS. 1 and 3). If the overlocking moment that has been set is exceeded, the transmission means can overlock, by reverse displacement of the coupling spring 24, and as a result the ring gear 22 is released and can rotate freely The rotary motion of the planet wheels 20 is now no longer transmitted to the planet wheel carrier 21, and the tool spindle 11 is driveless.

The prestressing of the coupling spring 24 is preselected by the torque adjusting ring 15. The torque adjusting ring 15 is capable of rotating a threaded ring 28, specifically via a slaving means 27 (FIG. 3) that protrudes axially from the threaded ring 28. By means of a screw thread 29, the threaded ring 28 is screwed onto the guide sleeve 13, so that the threaded ring 28 upon rotating is axially displaced and changes the prestressing of the coupling spring 24. The force of the coupling spring 24 is transmitted to the transmission ring 23 (FIG. 3) and hence to the face end of the ring gear 22 via two disks 30, which rest on three axially extending cams 231 of the transmission ring 23.

Figure 4:
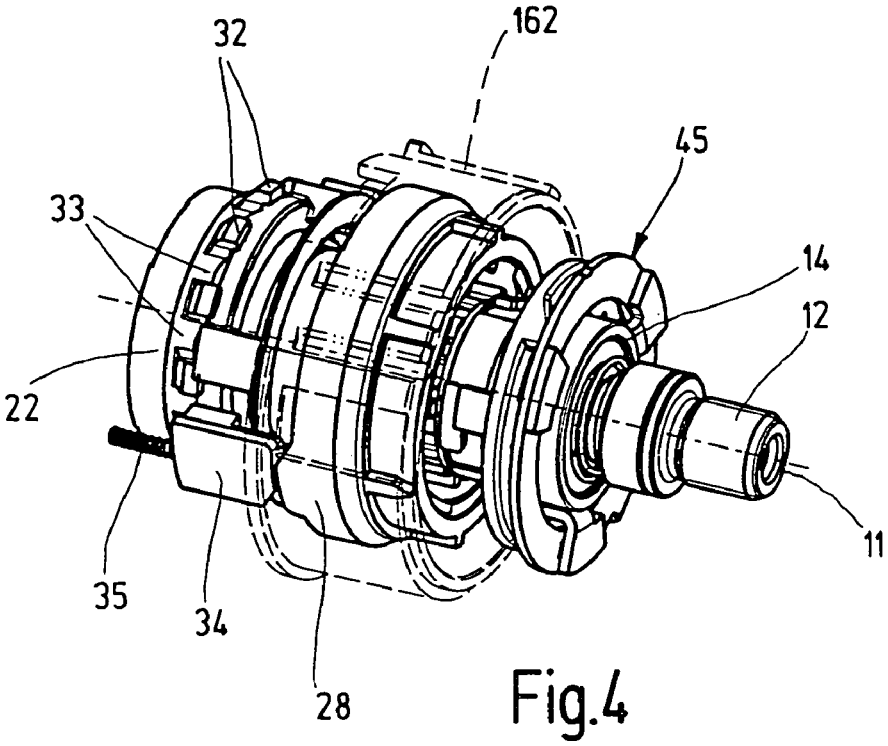
FIG. 4 is a perspective view of an assembly module in the exploded view of FIG. 3, with the blocking device activated.
Figure 5:
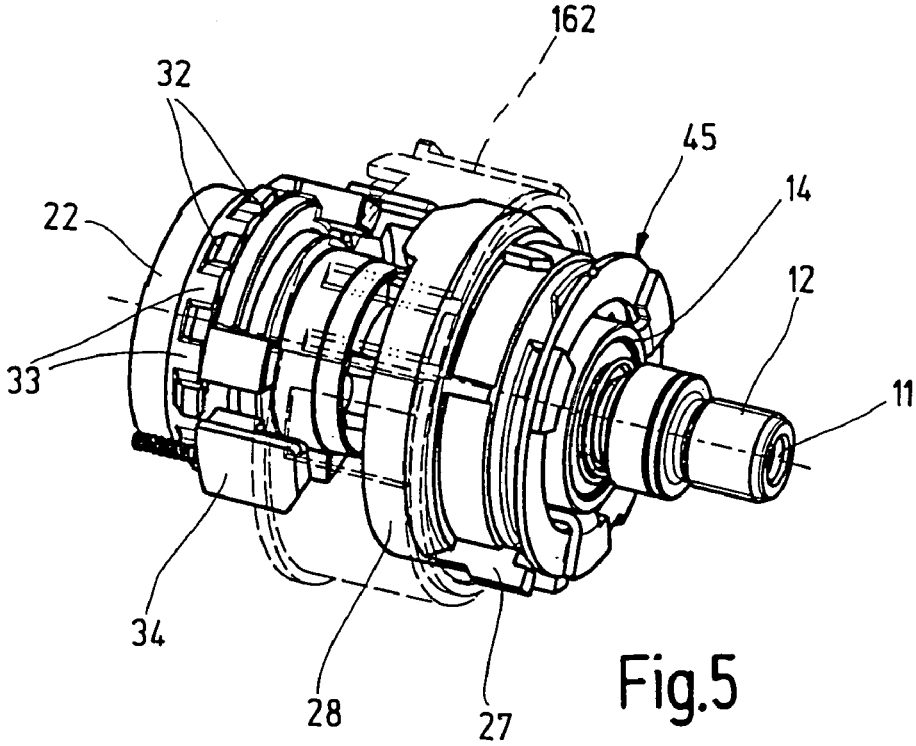
FIG. 5 is a view identical to FIG. 4, with the blocking device deactivated.

For the "drilling" and "percussion drilling" operating modes, the overlocking or overloading coupling 25 must be switched to be inoperative; that is, the ring gear 22 that forms one coupling part is fixed on the guide sleeve 13 in a manner that prevents relative rotation, without the capability of overlocking or overloading. To that end, the ring gear 22, on its outer circumference, has detent lugs 32, offset from one another by the same circumferential angles, with detent gaps 33 located between them (FIGS. 3 through 5), and the blocking device 31 has two slide wedges 34, which are located on the guide sleeve 13 axially displaceably counter to a restoring spring 35. On being axially displaced, the slide wedges 34 can each plunge in form-locking fashion into a respective detent gap 33 of the ring gear 22 and can thus bind the ring gear 22 to the guide sleeve 13 in a manner fixed against relative rotation.

Figure 9:
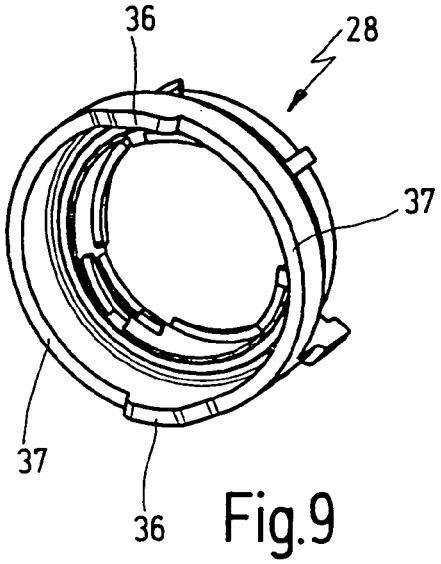
FIG. 9 is a perspective view of a control ring, cooperating with the torque adjuster for actuating the blocking device and preselecting the overlocking or overloading moment of an overlocking or overloading coupling.

The axial displacement of the slide wedges 34 is accomplished on the one hand by two control cams 36 on the threaded ring 28 (FIG. 9), which are each located at the end of a control curve 37 on the annular end face of the threaded ring 28. The slide wedges 34, under the influence of their restoring springs 35, rest on the two control curves 37. As soon as the torque adjusting ring 15 rotated into its "drilling" setting position, the slide wedges 34, by screwing the threaded ring 28 forward, run up onto the control cams 36 and are thereby thrust into the detent gaps 33 in the ring gear 22, so that the ring gear is fixed on the guide sleeve 13 in a manner that prevents relative rotation.

The function adjusting ring 16, which by rotation can be transferred into two setting positions, likewise accesses the blocking device 31, specifically in such a way that in its "percussion drilling" setting position, it inserts the slide wedges 34, counter to the force of the restoring spring 35, into the detent gaps 33 in the ring gear 22, and in its other setting position, it releases the slide wedges 34 again, so that they are thrust out of the detent gaps 33 by the restoring springs 35, and the ring gear 22 now meshes with the transmission ring 23 of the overlocking or overloading coupling 25 solely via the transmission elements.

Figure 10:
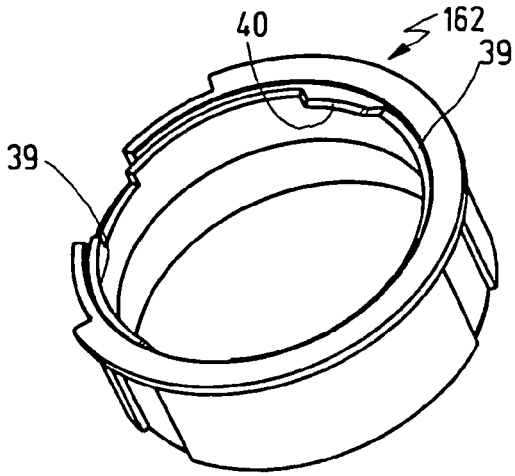
FIG. 10 is a perspective view of an inner ring of the two-part function adjusting ring.

As can be seen from FIGS. 1 and 3, the function adjusting ring 16 is embodied in two parts and comprises an outer ring 161 and an inner ring 162, which are joined together in a manner fixed against relative rotation. The inner ring 162 is rotatably supported on the guide sleeve 13 and achieves its axial bearing by means of a shell-like grasp 38 in the power tool housing 10. The threaded ring 28, rotating all the way around, is braced on the inside face of the inner ring 162. The inner ring 162 (FIG. 10), on its face end, has two control curves 39, on one end of each of which an axially protruding control cam 40 is located. The two control cams 40 are positioned such that upon rotation of the function adjusting ring 16 into its "percussion drilling" setting position, the control cams 40 run onto the slide wedges 34 and push them into the detent gaps 33 in the ring gear 22.

Figure 6:
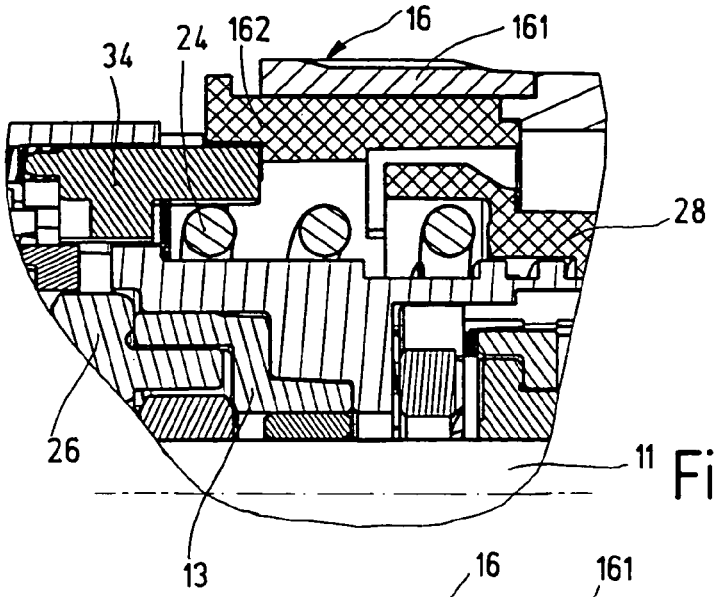
FIG. 6 shows a detail VI of FIG. 1, showing the inactive blocking device.
Figure 7:
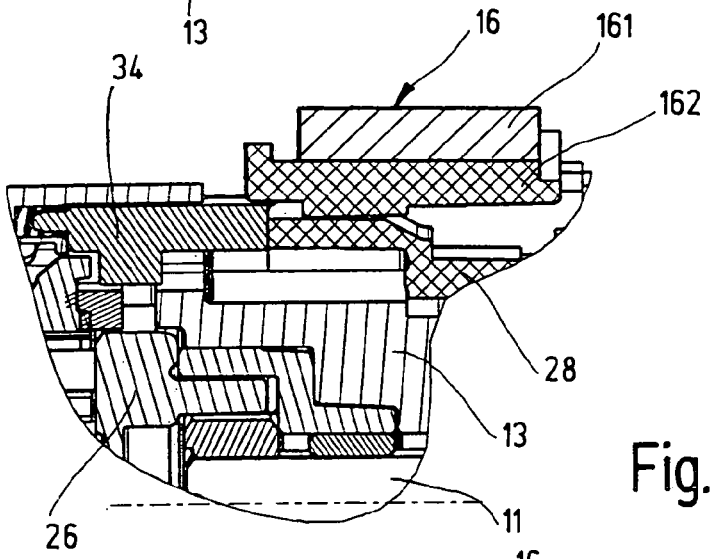
FIG. 7 is the same view as in FIG. 6, with a blocking device activated by a torque adjusting ring of an operating mode setting device.
Figure 8:
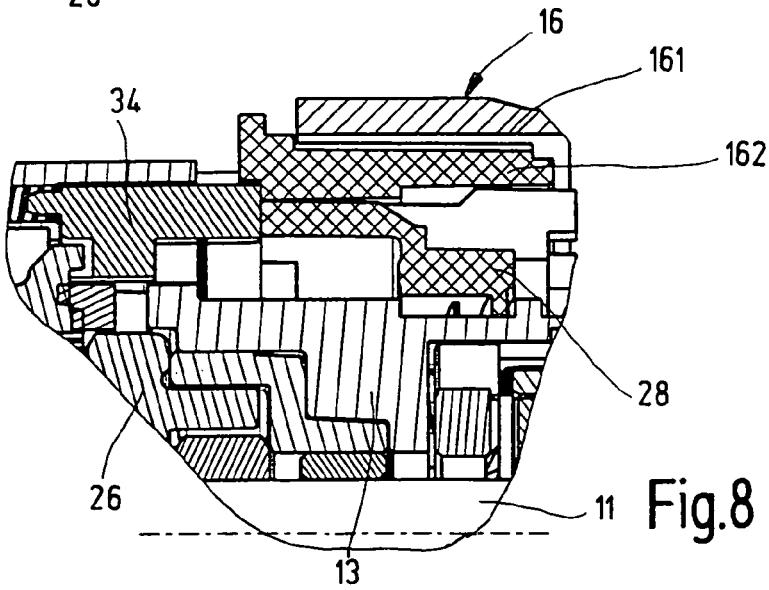
FIG. 8 is the same view as in FIG. 6, with a blocking device activated by a torque adjusting ring and a function adjusting ring of an operating mode setting device.

In FIGS. 6 through 8, the location of a slide wedge 34 in three different settings of the torque adjusting ring 15 and the function adjusting ring 16 is shown in fragmentary form. In FIG. 6, the blocking device 31 is inoperative. The slide wedges 34 have been pushed out of the detent gaps 33 of the ring gear 22. This is the case whenever the torque adjusting ring 15 is in its "screwdriving" setting position with an arbitrary preselection of torque, and the function adjusting ring 16 is in its other setting position, or in other words not in the "percussion drilling" setting position. In FIG. 7, the torque adjusting ring 16 has been moved to its "drilling" setting position. The rotary position of the function adjusting ring 16 is unchanged.

The control cams 36 on the threaded ring 28 have thrust the slide wedges 34 into the detent gaps 33 of the ring gear 22 and keep the slide wedges 34 in this thrust-in position, counter to the force of their restoring spring 35. In FIG. 8, the function adjusting ring 16 is additionally shown rotated into its "percussion drilling" setting position. The control cams 40 have pressed against the slide wedges 34 and hold them, as do the control cams 36 on the threaded ring 28, in the inserted position on the ring gear 22. If the torque adjusting ring 15 is now moved into its "screwdriving" setting position, then the control cams 36 on the threaded ring 28 lift away from the slide wedges 34 by axially reverse-screwing the threaded ring 28. However, as before, the inner ring 162 keeps the slide wedges 34 in engagement with the ring gear 22 and presses the ring gear 22, regardless of the rotary position of the torque adjusting ring 15, firmly against the guide sleeve 13 in a manner fixed against relative rotation.

If the function adjusting ring 16 is returned to its other setting position, then the control cams 40 release the slide wedges 34, and the slide wedges are expelled from the detent gaps 33 of the ring gear 22 by their restoring springs 35. The hand power tool is in the operating mode that is predetermined by the instantaneous position of the torque adjusting ring 15. As can be seen, by rotation of the function adjusting ring 16 into its "percussion drilling" setting position, the operating mode called up by the torque adjusting ring 15 is "overtaken" or overridden. The torque adjusting ring 15 can be rotated arbitrarily without becoming operative. Not until the function adjusting ring 16 has been reset to its other setting position does the torque adjusting ring 15 attain its described mode of operation.

Figure 11:
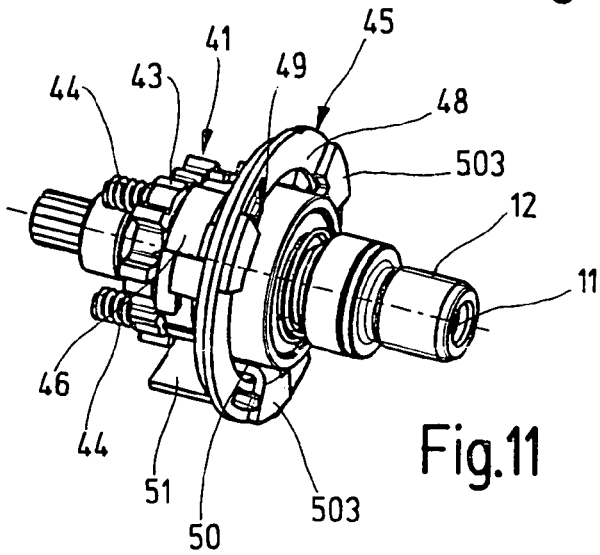
FIG. 11 is a perspective view of an assembly module comprising a threaded spindle of a cam device and its actuating unit.
Figure 12:
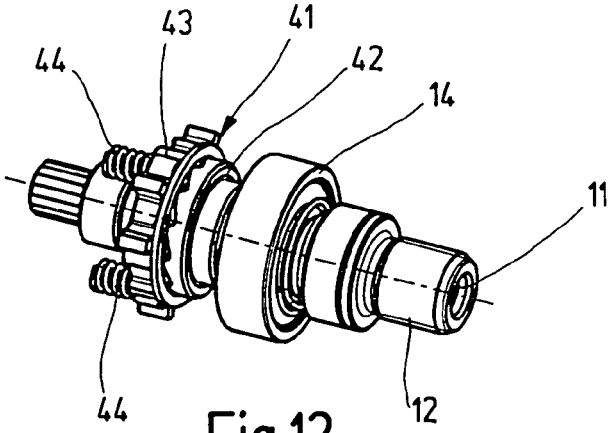
FIG. 12 is a perspective view of the assembly module of FIG. 11, without the actuating unit.

For the "percussion drilling" operating mode, a cam device 41 (FIGS. 1, 11 and 12) is provided on the tool spindle 11, in a known manner. The cam device 41 has two cam disks 42, 43, with cams oriented toward one another. One cam disk 42 is connected to the tool spindle 11 in a manner fixed against relative rotation, and the other cam disk 43 is limitedly axially displaceably embedded in the guide sleeve 13. The cam disk 43, on its side facing away from the cam disk 42, has three pegs, which are offset from one another by equal circumferential angles and which protrude axially from the cam disk 43. A compression spring 44 (FIGS. 11 and 12) is slipped onto each peg. The pegs with compression springs 44 slipped onto them are received in corresponding blind bores in the guide sleeve 13. The compression springs 44 are braced on the base of the blind bores and are compressed upon installation of the cam disk 43, so that they act upon the cam disk 43 with an axial pressure force.

The cam disk 43 thus rests in its receptacle in the guide sleeve 13 in an axial floating way, prestressed toward the cam disk 42 and mechanically limited. The axially floating bearing of the cam disk 43 is necessary to assure continuous drilling in the percussion drilling mode. With a slight contact pressure force of the tool against the workpiece, the cam disk 42 comes into engagement with the detent cams on the cam disk 43. However, the cam disk 43 can deflect axially counter to the prestressing force of the compression springs 44. The compression spring packet thus has a damping effect and absorbs some of the vibrational energy, which is important for drilling against hard, brittle workpiece surfaces. If the full percussion drilling vibration is required, as for instance in making coarse bores in masonry, fine concrete, and the like, then the contact-pressure force of the tool must be increased maximally, as a result of which the compression springs 44 are overridden, and the cam disk 43 is pressed against its axial mechanical stop in the guide sleeve 13. Thus the maximum possible undamped axial vibration energy reaches the drilling tool.

An actuating unit 45, controlled by the function adjusting ring 16, assures that when the function adjusting ring 16 is set to its "percussion drilling" setting position, the cam disks 42, 43 are brought into engagement with one another, and in the other setting position of the function adjusting ring 16, they are put out of engagement again. As long as the cam disks 42, 43 are in engagement with one another, the tool spindle 11 is additionally subjected to percussion upon rotation. The actuating unit 45 (FIGS. 3 and 11) has a control ring 46, with axially protruding humps 47 offset from one another on the circumference; a control disk 48, resting on the humps 47, with slits 49, offset by the same circumferential angles as the humps 47, for the humps 47 to pass through; and a holder 50, in which the ball bearing 14 of the tool spindle 11 is received.

The holder 50 has an annular bottom 501, three retaining arms 502 protruding from it, and three overfitting tabs 503, which are bent at the end of the retaining arms 502 and rest on the disk face, facing away from the humps 47, of the control disk 48.

In this position of the actuating unit 45, the ball bearing 14 and the tool spindle 11 are displaced axially so far that the cam disk 42, press-fitted onto the tool spindle 11, is disengaged from the cam disk 43. Upon rotation of the control disk 48, which is done via a slaving means 51 (FIG. 11), which is located on the control disk and is slaved by the function adjusting ring 16 upon the transfer of the function adjusting ring to the "percussion drilling" setting position, the slits 49 of the control disk 48 come to coincide with the humps 47 of the control ring 46, so that these humps pass through the slits 49, and the control disk 48 rests on the control ring 46. As a result, the control disk 48, the holder 50, and the ball bearing 14 with the tool spindle 11 move axially jointly with one another, and as a result the cam disks 42, 43 come into engagement with one another in order to generate the percussion frequency.

Figure 2:
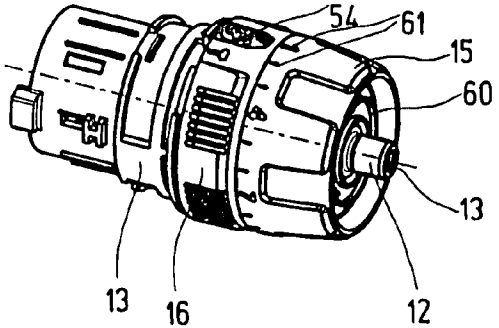
FIG. 2 is a fragmentary perspective view of the hand power tool of FIG. 1.

As can be seen from FIGS. 2 and 3, markings 61 located side by side in the circumferential direction are located on the torque adjusting ring 15, each indicating one setting position of the torque adjusting ring 15 for a defined magnitude of the overlocking (overloading) moment. For setting these setting positions, the torque adjusting ring 15 is detent-locked with an axially acting detent spring 52 and a detent disk 53 that is engaged axially on the inside by the detent spring 52. The final setting position of the torque adjusting ring 15 in the direction of rotation is identified by a symbol for the "drilling" operating mode.

In the function adjusting ring 16, there is a display window 54, in which a red face appears when the function adjusting ring 16 is set to its "percussion drilling" setting position, and a triangle 55 with its triangular tip pointing toward the torque adjusting ring 15 appears when the function adjusting ring 16 is set to the other setting position. This triangular tip serves as a reference marking for the markings 61 on the torque adjusting ring 15 and points to the setting position, set by the torque adjusting ring 15, which is indicated by the markings on the torque adjusting ring 15. The two symbols "red face" and "triangle" are located on a curved flat segment 56 (FIG. 3), which is thrust between the inner ring 162 and the outer ring 161 of the function adjusting ring 16 and is fixed on the guide sleeve 13 in a manner that prevents relative rotation. Depending on the rotary position of the function adjusting ring 16, one symbol appears in the display window 54, while the other symbol is covered by the outer ring 161.

Figure 13:
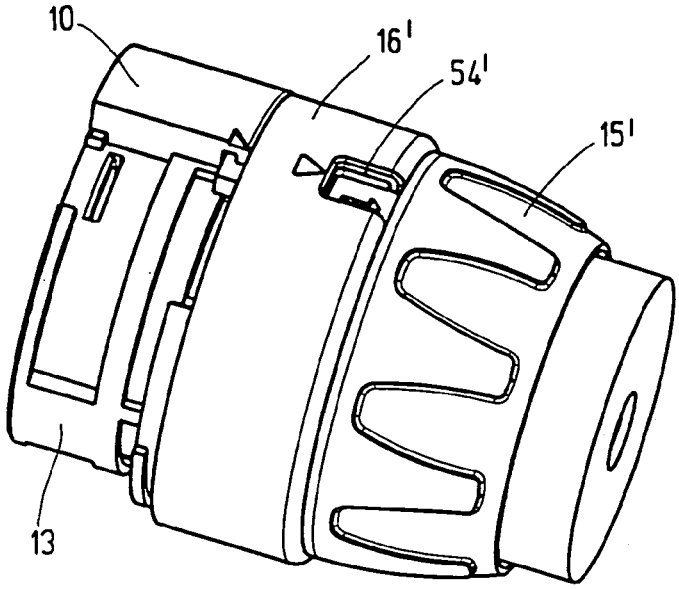
FIG. 13 is a perspective view of an assembly module of the hand power tool, in a further exemplary embodiment, with a modified operating mode setting device.
Figure 14:
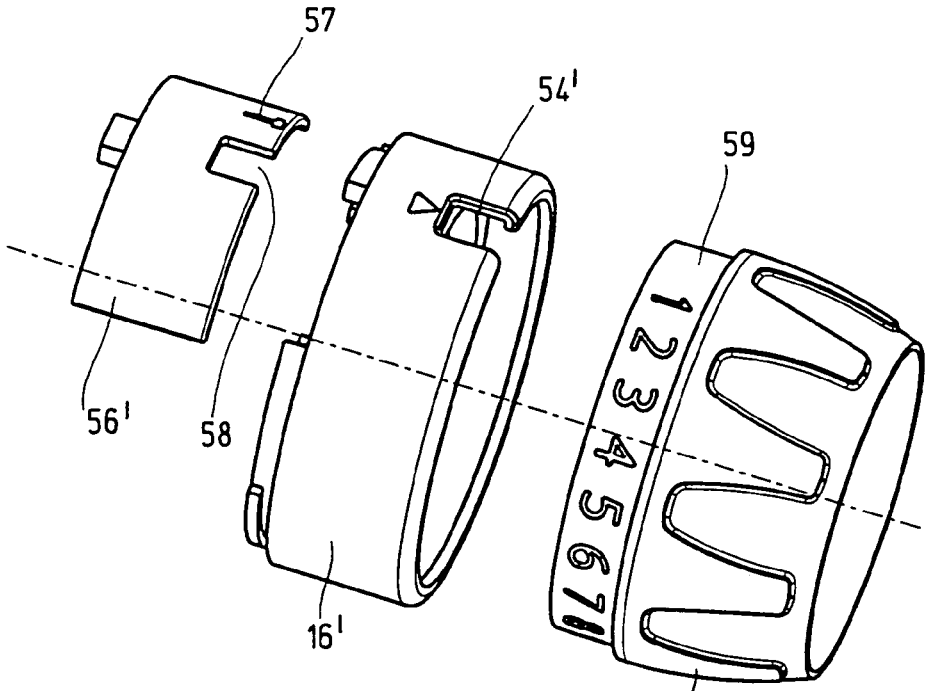
FIG. 14 is a perspective view of the torque adjusting ring, the function adjusting ring, and a covered disk of the operating mode setting device of FIG. 13.

In the modified version of the torque adjusting ring 15' and function adjusting ring 16' shown in FIG. 13 and FIG. 14, the function adjusting ring 16' again has the display window 54', but in the display window 54', not only the setting positions of the function adjusting ring 16' but also the setting positions of the torque adjusting ring 15' are displayed. A flat segment 56' is again located in the region under the display window 54' and is retained in the guide sleeve 13 in a manner fixed against relative rotation. The flat segment 56' has a painted-on hammer symbol 57 and a segment cutout 58, whose dimensions correspond to those of the display window 54'.

The torque adjusting ring 15' has an offset annular collar 59, which the function adjusting ring 16' fits over. Numbers are located side by side in the circumferential direction on the annular collar 59, symbolizing the setting positions of the torque adjusting ring 15' in which positions the overlocking (overloading) moment of the overlocking (overloading) coupling 25 is set with a deviating overlocking moment. The magnitude of the overlocking moment increases as the numbers become higher. At the end of the number scale, there is a symbol, not visible here, for the "drilling" setting position.

If the function adjusting ring 16' is in its "percussion drilling" setting position, then the hammer symbol 57 becomes visible through the display window 54'. The hand power tool is in the "percussion drilling" operating mode. If the function adjusting ring 16' is shifted from this setting position to its other setting position, then the display window 54' comes to coincide with the segment cutout 58 in the flat segment 56'. Depending on which setting position the torque adjusting ring 15' is set to, this setting position becomes visible in the display window 54', such as the number "1" for a setting position in which the hand power tool is in the "screwdriving" operating mode with the least overlocking (overloading) moment, or the drilling symbol, for instance, on the annular collar 59 that shows that the hand power tool is in the "drilling" operating mode.

It will be understood that each of the elements described above, or two or more together, may also find a useful application in other types of constructions differing from the types described above.

While the invention has been illustrated and described as embodied in a hand power tool, in particular drilling screwdriver, it is not intended to be limited to the details shown, since various modifications and structural changes may be made without departing in any way from the spirit of the present invention.

Without further analysis, the foregoing will so fully reveal the gist of reveal present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. A hand power tool, comprising a power tool housing; a tool spindle supported rotatably in said housing; a drive train via which said tool spindle is drivable to rotate; a cam device located in said drive train and having two cam discs in engagement with one another for transmitting axial percussion motions to said tool spindle; an overloading coupling located in said drive train and having two coupling parts which are in engagement with one another and are overloadable counter to an axially exerted force; a coupling spring exerting said axial force; a blocking device which upon its activation blocks a relative rotation of said coupling parts of said overloading coupling to one another; and an operating mode setting device for setting "percussion drilling", "drilling" and "screw driving" operating modes, and also a magnitude of an overloading moment upon screwdriving, said operating mode setting device having two adjusting rings located on said power tool housing and rotatable manually to define setting positions and acting on said cam device, said overloading coupling and said blocking device, wherein one of said adjusting rings is a torque adjusting ring and sets the "drilling" operating mode and the "screwdriving" operating mode, with preselection of the magnitude of the overloading moment, while the other of said adjusting rings is embodied as a function adjusting ring and switches the "percussion drilling" operating mode on and off, and in its position that switches the "percussion drilling" operating mode on, it overrides any operating mode set by said torque adjusting ring, wherein said torque adjusting ring has a plurality of setting positions and accesses said overloading coupling and said blocking device in such a way that in a setting position that sets the "drilling" operating mode, said blocking device is activated, and in other setting positions the blocking device is deactivated, and said coupling spring of said overloading coupling is prestressed variously strongly, said function adjusting ring having two setting positions and accesses said cam device and said blocking device in such a way that in one setting position said "percussion drilling" operating mode is switched on and said blocking device is activated, and in the another setting position, said percussion drilling function is switched off and said blocking device is deactivated.

2. A hand power tool as defined in claim 1, wherein two of said setting positions of said function adjusting ring are visible as symbols in a display window embodied in said function adjusting ring.

3. A hand power tool as defined in claim 2, wherein in the setting position of said function adjusting ring for the "percussion drilling" operating mode, a red face is visible and in another setting position a triangle with a tip pointing toward said torque adjusting ring is visible as symbols in said display window.

4. A hand power tool as defined in claim 3, wherein said torque adjusting ring is provided with markings identify said setting positions of said torque adjusting ring, some of said setting positions whose markings are aligned with said triangular tip in said display window in said function adjusting ring being set with said torque adjusting ring.

5. A hand power tool as defined in claim 2, wherein said function adjusting ring is split in two and has an outer ring and an inner ring which are connected to one another in a manner fixed against relative rotation, said display window being located in said outer ring; and further comprising a flat segment carrying the symbols and located nonrotatably in a region of said display window between said outer ring and said inner ring.

6. A hand power tool as defined in claim 1, wherein said setting positions of said function adjusting ring and said torque adjusting ring are visible in a display window provided in said function adjusting ring.

7. A hand power tool as defined in claim 6, wherein said torque adjusting ring has a radially offset annular collar on which markings identifying said setting positions of said torque adjusting rings are located, said annular collar being covered by an end portion, carrying said display window, of said function adjusting ring; and further comprising a flat segment protruding into an overlapping region of said function adjusting ring and said torque adjusting ring and having a segment cutout with dimensions corresponding to dimensions of said display window and also having a hammer symbol located adjacent to said segment cutout in a direction of rotation.

8. A hand power tool as defined in claim 1, wherein said torque adjusting ring is coupled in a slaving fashion to a threaded ring that is screwable onto a guide sleeve, said threaded ring on its end face toward said slide wedges having a number corresponding to a number of said slide wedges of control cams offset from one another by same circumferential angles as said slide wedges, for axially displacing said slide wedges into said detent gaps of said detent lock of said ring gear.

9. A hand power tool as defined in claim 8, wherein said coupling spring of said overloading coupling is received on said guide sleeve and is braced between said transmission rings and said threaded ring.

10. A hand power tool, comprising a power tool housing; a tool spindle supported rotatably in said housing; a drive train via which said tool spindle is drivable to rotate; a cam device located in said drive train and having two cam discs in engagement with one another for transmitting axial percussion motions to said tool spindle; an overloading coupling located in said drive train and having two coupling parts which are in engagement with one another and are overloadable counter to an axially exerted force; a coupling spring exerting said axial force; a blocking device which upon its activation blocks a relative rotation of said coupling parts of said overloading coupling to one another; and an operating mode setting device for setting "percussion drilling", "drilling" and "screw driving" operating modes, and also a magnitude of an overloading moment upon screwdriving, said operating mode setting device having two adjusting rings located on said power tool housing and rotatable manually to define setting positions and acting on said cam device, said overloading coupling and said blocking device, wherein one of said adjusting rings is a torque adjusting ring and sets the "drilling" operating mode and the "screwdriving" operating mode, with preselection of the magnitude of the overloading moment, while the other of said adjusting rings is embodied as a function adjusting ring and switches the "percussion drilling" operating mode on and off, and in its position that switches the "percussion drilling" operating mode on, it overrides any operating mode set by said torque adjusting ring, wherein a plurality of said setting positions are located on said torque adjusting ring such that said overloading moment increasing from one setting position to a next one, and said second position for setting position for setting the "drilling" operating mode is located at an end of a path of rotation of said torque adjusting ring.

11. A hand power tool, comprising a power tool housing; a tool spindle supported rotatably in said housing; a drive train via which said tool spindle is drivable to rotate; a cam device located in said drive train and having two cam discs in engagement with one another for transmitting axial percussion motions to said tool spindle; an overloading coupling located in said drive train and having two coupling parts which are in engagement with one another and are overloadable counter to an axially exerted force; a coupling spring exerting said axial force; a blocking device which upon its activation blocks a relative rotation of said coupling parts of said overloading coupling to one another; and an operating mode setting device for setting "percussion drilling", "drilling" and "screw driving" operating modes, and also a magnitude of an overloading moment upon screwdriving, said operating mode setting device having two adjusting rings located on said power tool housing and rotatable manually to define setting positions and acting on said cam device, said overloading coupling and said blocking device, wherein one of said adjusting rings is a torque adjusting ring and sets the "drilling" operating mode and the "screwdriving" operating mode, with preselection of the magnitude of the overloading moment, while the other of said adjusting rings is embodied as a function adjusting ring and switches the "percussion drilling" operating mode on and off, and in its position that switches the "percussion drilling" operating mode on, it overrides any operating mode set by said torque adjusting ring, wherein one coupling part of said overloading coupling is formed by a ring gear of a planetary gear having internal toothing and an external detent lock with detent lugs and detent gaps, the other coupling part of said overloading coupling being formed by an axially displaceable transmission ring fixed against relative rotation, that is acted upon by said coupling spring, said blocking device having at least two axially displaceable slide wedges fixed against relative rotation, which are insertable counter to spring force into said detent gaps of said detent lock on said ring gear.

12. A hand power tool as defined in claim 11, wherein said inner ring of said function adjusting ring on its face end toward said slide wedges has a number corresponding to a number of said slide wedges of control cams, offset from one another by same circumferential angles as said slide wedges for axially displacing said slide wedges.

13. A hand power tool, comprising a power tool housing; a tool spindle supported rotatably in said housing; a drive train via which said tool spindle is drivable to rotate; a cam device located in said drive train and having two cam discs in engagement with one another for transmitting axial percussion motions to said tool spindle; an overloading coupling located in said drive train and having two coupling parts which are in engagement with one another and are overloadable counter to an axially exerted force; a coupling spring exerting said axial force; a blocking device which upon its activation blocks a relative rotation of said coupling parts of said overloading coupling to one another; and an operating mode setting device for setting "percussion drilling", "drilling" and "screw driving" operating modes, and also a magnitude of an overloading moment upon screwdriving, said operating mode setting device having two adjusting rings located on said power tool housing and rotatable manually to define setting positions and acting on said cam device, said overloading coupling and said blocking device, wherein one of said adjusting rings is a torque adjusting ring and sets the "drilling" operating mode and the "screwdriving" operating mode, with preselection of the magnitude of the overloading moment, while the other of said adjusting rings is embodied as a function adjusting ring and switches the "percussion drilling" operating mode on and off, and in its position that switches the "percussion drilling" operating mode on, it overrides any operating mode set by said torque adjusting ring; and further comprising an actuating unit configured for bringing said cam discs of said cam device into and out of engagement with one another and controlled by said function adjusting ring.

14. A hand power tool as defined in claim 13, wherein said actuating unit has a control disc with a slaving means for rotary slaving by said function adjusting ring and has at least two slits offset from one another in a circumferential direction, a control ring with an annular end face toward said control disc, humps offset from one another by same circumferential angles as said slits, and a holder that holds said tool spindle via a bearing and that rests with overfitting tabs on a disc face facing away from said control ring of said control disc, said function adjusting ring being coupled to said control disc via slaving means in such a way that upon setting of said function adjusting ring to its setting position identifying the "percussion drilling" operating mode, said control disc is rotated such that said humps on said control ring extend through said slits in said control disc and thereby put said cam discs into detent engagement with one another, and with a setting of said function adjusting ring into its another setting position, said control disc is rotated such that said humps emerge from said slits and slide onto said discs face facing away from said overfitting tabs of said control discs and thereby put said cam discs out of engagement with one another.

* * * * *